US007337635B2

(12) United States Patent
Cerruti et al.

(10) Patent No.: US 7,337,635 B2
(45) Date of Patent: Mar. 4, 2008

(54) WASHING AGENT DISPENSER FOR A DOMESTIC WASHING MACHINE, NAMELY A DISHWASHER

(75) Inventors: Daniele Cerruti, Fontanetto Po (IT); Giovanni Perucca, Motta de' Conti (IT); Fabio Nebbia, Giarole (IT); Stefano Belfiore, Borgo San Martino (IT)

(73) Assignee: Eltek S.p.A., Casale Monferrato (IT)

( * ) Notice: Subject to any disclaimer, the term of this patent is extended or adjusted under 35 U.S.C. 154(b) by 421 days.

(21) Appl. No.: 10/312,156

(22) PCT Filed: Jun. 22, 2001

(86) PCT No.: PCT/IB01/01115

§ 371 (c)(1),
(2), (4) Date: Mar. 19, 2003

(87) PCT Pub. No.: WO01/97674

PCT Pub. Date: Dec. 27, 2001

(65) Prior Publication Data

US 2003/0188768 A1 Oct. 9, 2003

(30) Foreign Application Priority Data

Jun. 22, 2001 (IT) ..... TO2000A0614

(51) Int. Cl.

| | |
|---|---|
| ***D06F 29/00*** | (2006.01) |
| ***D06F 35/00*** | (2006.01) |
| ***B08B 7/02*** | (2006.01) |
| ***B08B 9/20*** | (2006.01) |
| ***B08B 3/00*** | (2006.01) |
| *B67D 3/00* | (2006.01) |
| *B67D 5/06* | (2006.01) |

(52) U.S. Cl. ..... 68/17 R; 68/17 A; 68/210; 134/17; 134/25.2; 134/25.5; 134/55; 134/92; 134/93; 222/538; 222/539; 222/573

(58) Field of Classification Search ..... 68/17 R, 68/17 A, 210; 222/538, 539, 573; 134/17 R, 134/25.2, 25.5, 55 D, 84, 92, 93
See application file for complete search history.

(56) References Cited

U.S. PATENT DOCUMENTS

| | | | | |
|---|---|---|---|---|
| 5,133,487 | A * | 7/1992 | Russi | 222/651 |
| 5,456,357 | A * | 10/1995 | Wenner et al. | 206/372 |
| 5,873,268 | A * | 2/1999 | Spriggs et al. | 68/17 R |

FOREIGN PATENT DOCUMENTS

DE 19843976 A1 * 9/1998

* cited by examiner

*Primary Examiner*—Michael Barr
*Assistant Examiner*—Rita R Patel
(74) *Attorney, Agent, or Firm*—Fredrikson & Byron, P.A.

(57) ABSTRACT

Washing agent dispenser for a household washing machine, namely a dishwasher, which dispenser has a body (2) delimiting at least a recess (3) for containing a certain amount of washing agent, comprising occlusion means (4,5) for said recess (3).

According to the invention, said occlusion means (4,5) are capable of taking at least two different operating conditions for a partial opening of said recess (3), one for loading said amount of washing agent, the other for its subsequent dispensing.

46 Claims, 7 Drawing Sheets

FIG. 10
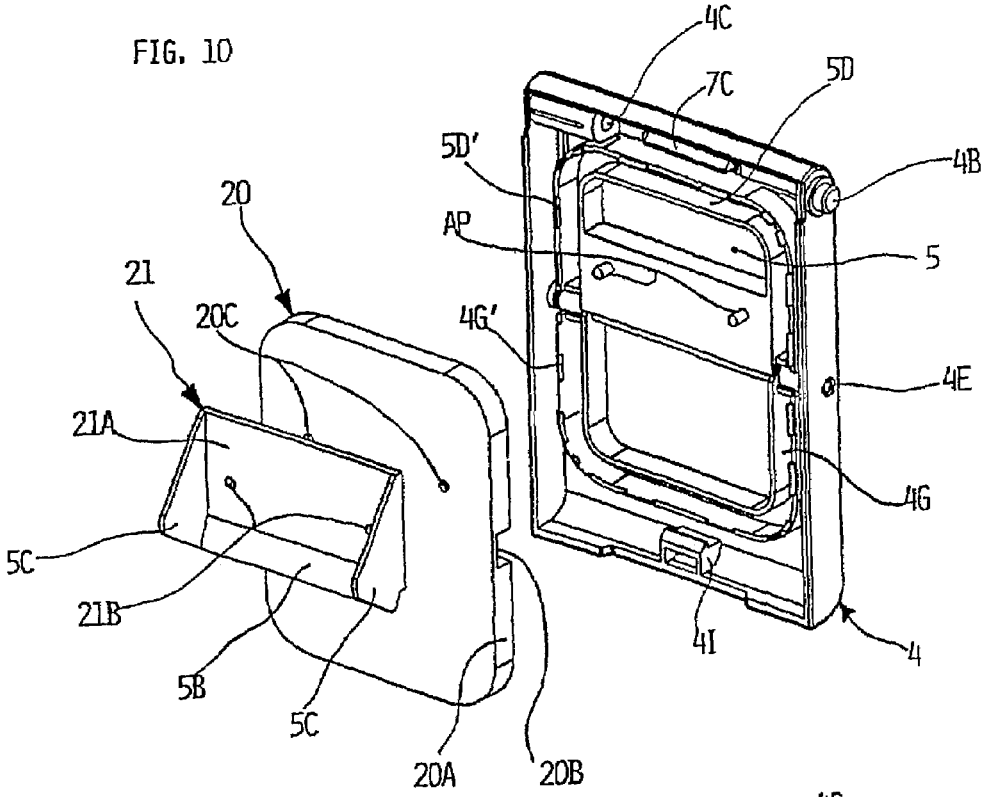
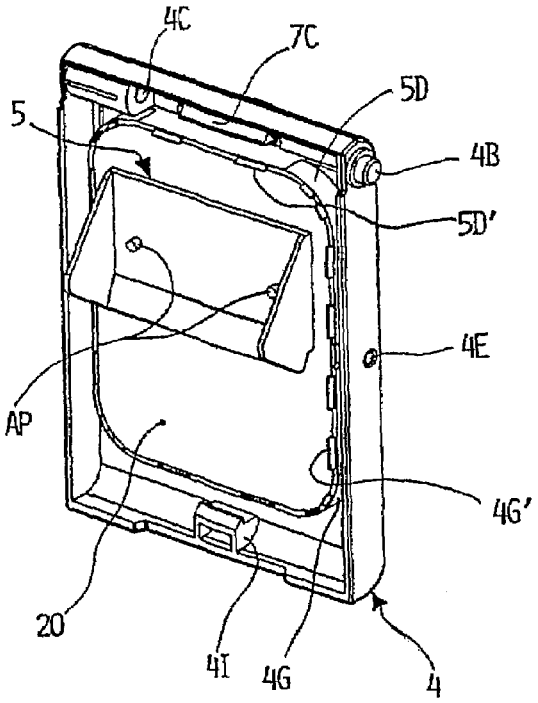
FIG. 11
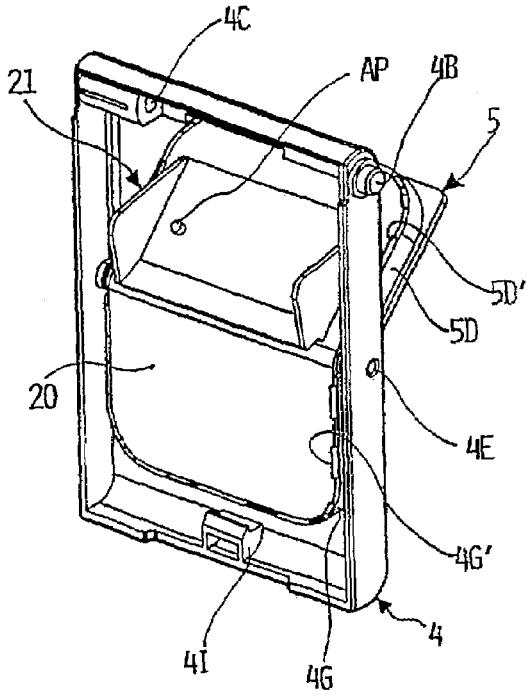
FIG. 12

WASHING AGENT DISPENSER FOR A DOMESTIC WASHING MACHINE, NAMELY A DISHWASHER

DESCRIPTION

The present invention relates to a washing agent dispenser device for a household washing machine, namely a dishwasher, of the type indicated in the preamble of the annexed claims 1 and/or 46.

As known, washing machines are usually fitted with a washing agents dispenser, namely detergents and washing aids in powder and/or liquid; the latter typically consist of softening media for laundry washing machines and rinsing aids for dishwashing machines. In the instance of a dishwasher, the washing agent dispenser usually comprises a plastic body partially built-in on one of the vertical surfaces delimiting the machine wash tub; in most cases, this vertical wall consists of the dishwasher inner-door, i.e. the side of the machine front loading door facing inside the wash tub.

In its front area the above body delimits a recess with a closing cover, for containing a certain amount of washing agent, usually in powder or in form of a tablet, as required for performing a wash cycle.

A tank is also provided inside the dispenser body, for containing a second liquid washing agent, typically a rinsing aid; usually, the capacity of the above tank is such to contain a sufficient amount of liquid agent to perform several wash cycles: thus, the machine user will only have to fill the tank through a proper plug, periodically.

Inside the dispenser a compartment associated to the above tank is used for dosing the amount of rinsing aid to be released during a wash cycle; to this purpose, the rinsing-aid dosing system typically utilizes the opening-closing movement of the machine door, i.e. horizontal in its open position and vertical in its closed position, for supplying some of the rinsing aid from the tank to the dosing compartment; during machine operation, a programmer or timer operates an actuator to release a discharge outlet in line with the dosing compartment and let the dosed amount of rinsing aid flow from the latter into the wash tub of the dishwasher.

The above technique previously known presumes to have the dispenser fastened to the dishwasher door, so as to utilize the door opening/closing movement for dosing the rinsing aid required for the execution of a wash cycle; therefore, application of the above dispensers is actually restricted to those washing machines fitted with a tilting door on a horizontal axis.

For the above reasons, the dispenser is so structured to have the opening of the recess containing the washing agent facing upwards with the machine door open; thus, after having brought the door to its horizontal position, the user can load the washing agent in the above recess, shut the relevant cover and then close the machine door again; usually, the recess cover is either tilting or sliding type; its opening at right time during the wash cycle is controlled by a programmer or timer of the machine, so as to have the washing agent fall into the wash tub either by gravity or through the washing of the recess by means of the spraying elements of the dishwasher.

Therefore, the above technique previously known requires to load the washing agent in the relevant recess with the machine door open, i.e. a relatively uncomfortable position for the user, above all considering that unlike a rinsing aid, a powder or liquid washing agent or in the form of a tablet has to be introduced before starting every wash cycle.

Other common washing machines, vice-versa, have no tilting loading door, but the latter is linearly sliding on special guides; reference is specifically made to a twin-basket dishwashing machine, i.e. the solution described in FR-A-2.674.426; according to other common solutions, the dishwasher has one single basket containing the crockery to be washed structured like a sliding drawer, whose front wall actually forms the machine door. Also in these machines the washing agents dispenser is fastened to the machine door or anyway to a wall or vertical surface delimiting the washing tub, so that the dispenser will always rest on one same laying plane, independently from the open or closed condition of the door.

The dispensers employed on these machines require a special electric pump for dosing and dispensing the liquid washing agent. As regards powder or solid washing agents, on the contrary, said dispensers comprise a housing seat for a container open upwards, which is partially tilting and hinged to the lower end.

Such container can be partially extracted from its relevant seat, inclining it outside of the dispenser body to load the washing agent dose inside it; the container is then brought back to its relevant housing seat delimited in the dispenser body through a reverse motion.

This solution is rather complex and expensive, since it requires a special hydraulic circuit apt to convey water inside the above container for removing the washing agent and convey it into the machine wash tub; moreover, this solution is further complex, expensive and critical considering that such hydraulic circuit should be partially housed within the machine door.

Finally, long-term soap-powder dispensers assembled on the machine door are also known, which comprise a tank apt to contain enough washing agent for executing a plurality of wash cycles, and comprise single dose dispensing means defined on a volumetric basis of such washing agent.

Quite schematically, the dosing and dispensing means according to these solutions comprise a substantially cylindrical body, angularly movable and bearing one or more recesses, mounted below the outlet of the washing agent tank.

During a first step, a suitable actuator rotates the cylindrical body to bring one of its recesses in line with said outlet; thus, a portion of the washing agent contained in the tank can fill this recess by gravity.

Later, the cylindrical body will rotate by about 180°, in order to bring the above recess in line with a lower outlet facing the machine wash tub, wherein the washing agent contained in the recess can fall down by gravity.

A similar solution is described e.g. in IT-A-1.242.282.

According to these solutions, loading the washing agent is easier for the user, both because the operation can be performed at intervals and with the machine door half-opened; some solutions, also, provide for removal of the washing agent tank to make loading extremely comfortable for the user (see e.g. IT-A-1.242.282 mentioned above).

However, also the above long-term dispensers have some drawbacks.

A first drawback is due to a considerable manufacturing complexity of the device, which requires the use of many components and kinematics, as well as an actuator suitable for rotating the dosing and dispensing drum, which is subject to many movement frictions. Another drawback is due to the device overall dimensions, which require a considerable space inside the wash tub; in fact, housing the device inside the machine inner-door would prove quite difficult and critical in case of maintenance being required.

Another drawback is due to the hygroscopic isolation required inside the device against the environment outside, to avoid possible deterioration of the washing agent contained in the tank, caused by humidity and water in the machine tub during washing; this involves the use of suitable sealing systems, namely peripheral ones, which are subject to wear and make the device more complex, both from a manufacturing and functional standpoint, leading to a further cost increase.

It is the object of the present invention to solve the above drawbacks and provide a washing agent dispensing device for a washing machine, apt for dispensing an amount of washing agent as required for performing a treatment cycle of the machine, which is simple to manufacture, comfortable to use, has a reliable operation and lower costs.

In this frame, it is the first object of the present invention to provide such a dispenser, wherein loading the washing agent can take place in a comfortable easy position for the user, both when the device is fastened to sliding doors or consistent vertical surfaces and/or fastened to tilting doors.

Another object of the present invention is to provide such dispenser comprising a very small number of components of simple construction, a very small number of movable elements, which does not require any complex systems for dispensing the washing agent. Another object of the present invention is to provide such dispenser employing simple reliable actuating and sealing means.

Another object of the present invention is to provide such dispenser, which can be assembled and operate indifferently on tilting doors, and/or sliding doors, and/or consistent vertical surfaces.

In order to achieve one or more of such aims, it is the object of the present invention to provide a washing agent dispenser device for a household washing machine, namely a dishwasher, incorporating the features of the annexed claims, which form an integral part of the description herein.

Further objects, features and advantages of the present invention will become apparent from the following detailed description and annexed drawings, which are supplied by way of non limiting example, wherein:

FIG. 10 shows an exploded view of a component of a washing agent dispenser according to a first possible embodiment of the present invention;

FIGS. 11 and 12 show the component of FIG. 10 in two different operating conditions;

Figure 1:
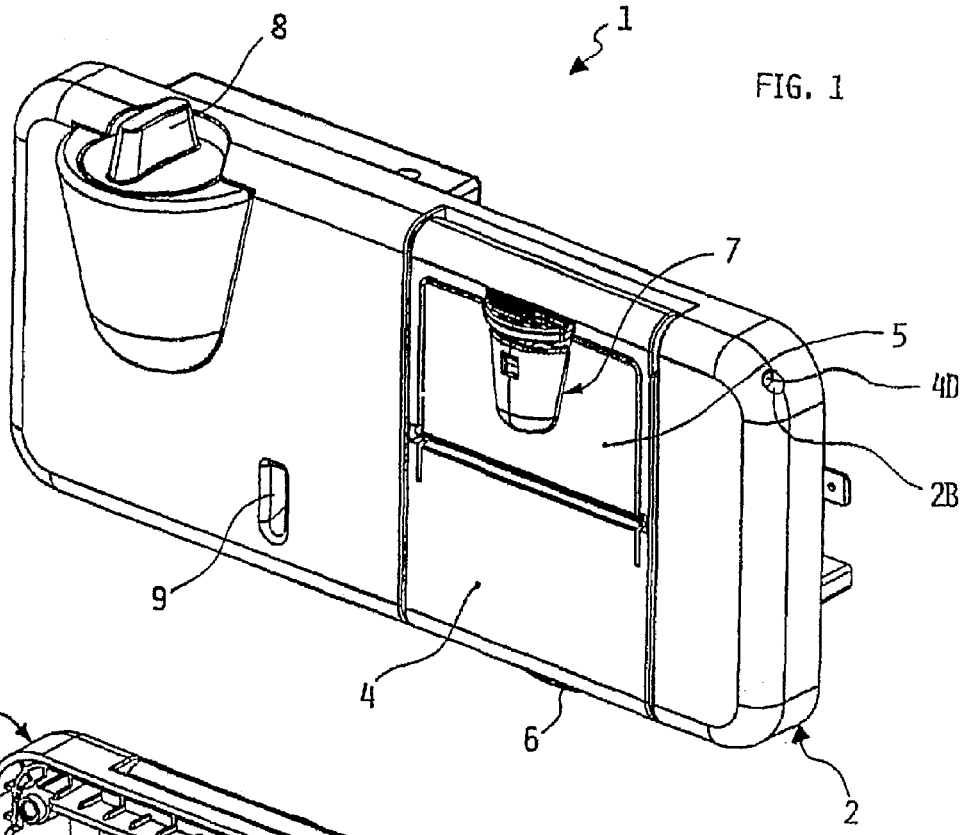
FIG. 1 shows a prospective view of the front side of a washing agent dispenser according to the present invention.

In the annexed Figures reference 1 indicates in its whole an example of embodiment of a washing agent dispenser according to the present invention for use on a washing machine; the example shown assumes this machine to be a dishwasher.

The dispenser 1 has a main body 2, to be at least partially housed in an aperture on the inner door of the dishwashing machine door, which may be either tilting or sliding; in general, the body 2 can be fastened to any surface delimiting a dishwasher wash tub, in particular a vertical wall; according to common art, the body 2 of the dispenser 1 is manufactured e.g. by welding a thermoplastic front part and rear part together.

In such body 2 are defined a tank containing of a liquid washing agent, not shown in the Figures, and a recess indicated with 3 in the FIGS. 3, 5-9 for receiving a determinate dose of washing agent as required for the execution of a wash cycle; for the purposes of the following description, this washing agent is assumed to be in powder; however, the present invention is capable of application also in the instance of other washing agents, either liquid or in the form of a tablet, gel or foam.

Reference 4 indicates a first tilting cover for closing the recess 3 in its whole; as better detailed in the following, the cover 4 has a loading window indicated with 4A in FIG. 3, in line with the loading window 4A is mounted a second cover 5, also called flap in the following, hinged to the cover 4.

Reference 6 indicates a hooking lever of the cover 4; with 7 is indicated a complete opening/closing device for the flap 5 with respect to the cover 4. Reference 8 indicates the plug of an aperture in communication with the above tank, for loading the liquid washing agent in the latter. Reference 9 indicates an outlet through which a dose of such liquid washing agent can be flown down to the wash-tub of the dishwasher according to common procedures.

Figure 2:
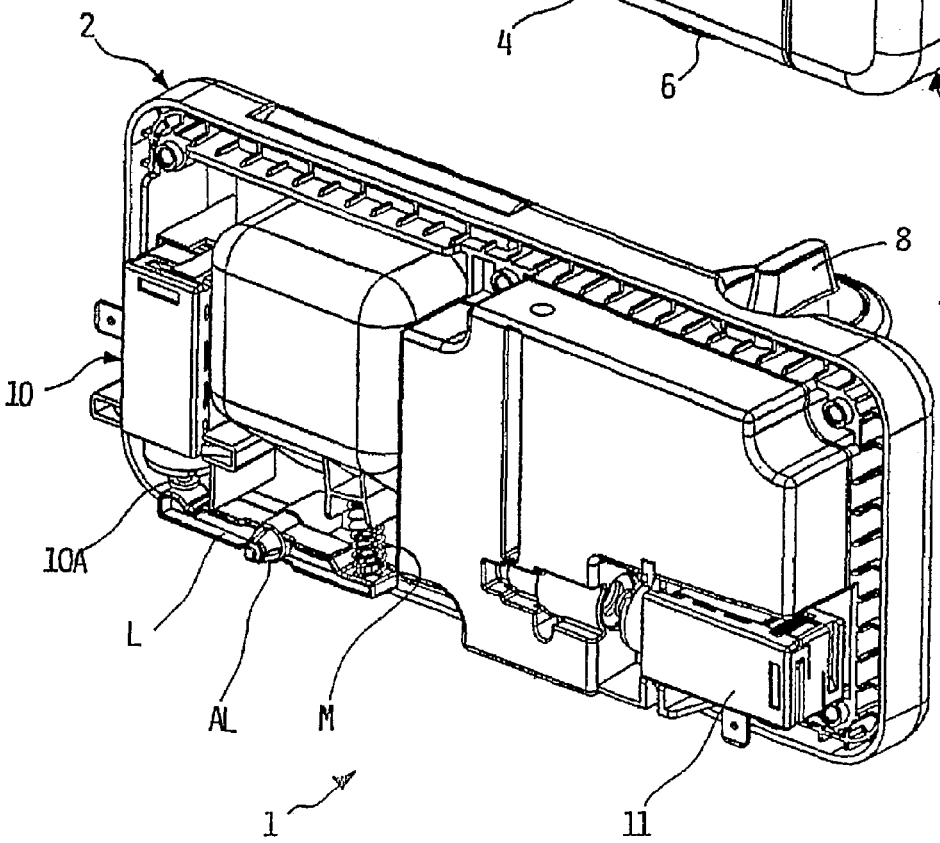
FIG. 2 shows a prospective view of the rear side of a washing agent dispenser according to the present invention.

Referring specifically to FIG. 2, reference 10 indicates a general actuator commonly fastened to the body 2 for actuating the hooking lever 6 of FIG. 1 through an appropriate kinematics, provided for the opening of the cover 4.

In particular, L indicates a lever, a first end of which is located below a piston 10A of the actuator 10; M indicates a compression spring, operating between the second end of the lever L and the body 2; a shaft AL integral on an intermediate location of the lever L, is inserted in a special path through the body 2 and connected to the hooking lever 6 of FIG. 1. Thus, the actuator 10, lever L, spring M, shaft AL and lever 6 form a substantially common opening/closing system for the small cover 4, whose operation will be further described.

Back to FIG. 2, reference 11 indicates a second actuator, alike the one indicated with 10, for dosing and dispensing of a dose of a liquid washing agent contained in the relevant tank through an appropriate common kinematics not visible in the figures; this kinematics may be any common type apt for consistent operation in vertical position, i.e. it has not to be laid down for the dosing function of the amount of washing agent to be dispensed.

It should be noticed that both the actuators 10 and 11, as well as their relevant kinematics may be common ones, since their manufacture is apart from the purposes of the present invention.

For instance, these actuators 10 and 11 may be thermal or electro-thermal actuators, called thermo-actuators in the following, with a general structure as described in WO-A98/32141, whose teachings in this respect are considered incorporated herein for reference. Here it is simply remembered that the thermo-actuators as indicated with 10 and 11 comprise an outer housing containing a body made of electric and thermal conductive material (e.g. metal) connected to an electric heater; in the above body is delimited a chamber, which contains a thermal extendable material (such as wax) and at least partially a thrusting element apt to cause the displacement of a piston protruding out of the outer housing; the electric heater typically consists of a positive temperature coefficient PTC, electrically supplied by means of two terminals.

With the supply terminals under voltage, the electric heater run by the current will generate heat and cause expansion of the thermal expandable material: in its turn, this expansion causes a linear displacement of the thrusting element outside its relevant body, so as to cause a piston motion until it reaches a given position, generally established by a mechanical stop, which may be defined as a final work position. Upon ceasing the electric supply, the heater cools down and the thermo-expandable material will shrink, causing the piston and thrusting element to go back to their initial rest position, eventually also with the help of an elastic recall element, such as a spring. Therefore, thermo-actuators as above are devices of mono-stable type, providing a single work run and one final work position beside their usual rest position. Important advantages of these actuators are the considerable work force or power that they are able to develop related to their small overall dimensions, low cost, low consumption and noiseless operation.

Figure 3:
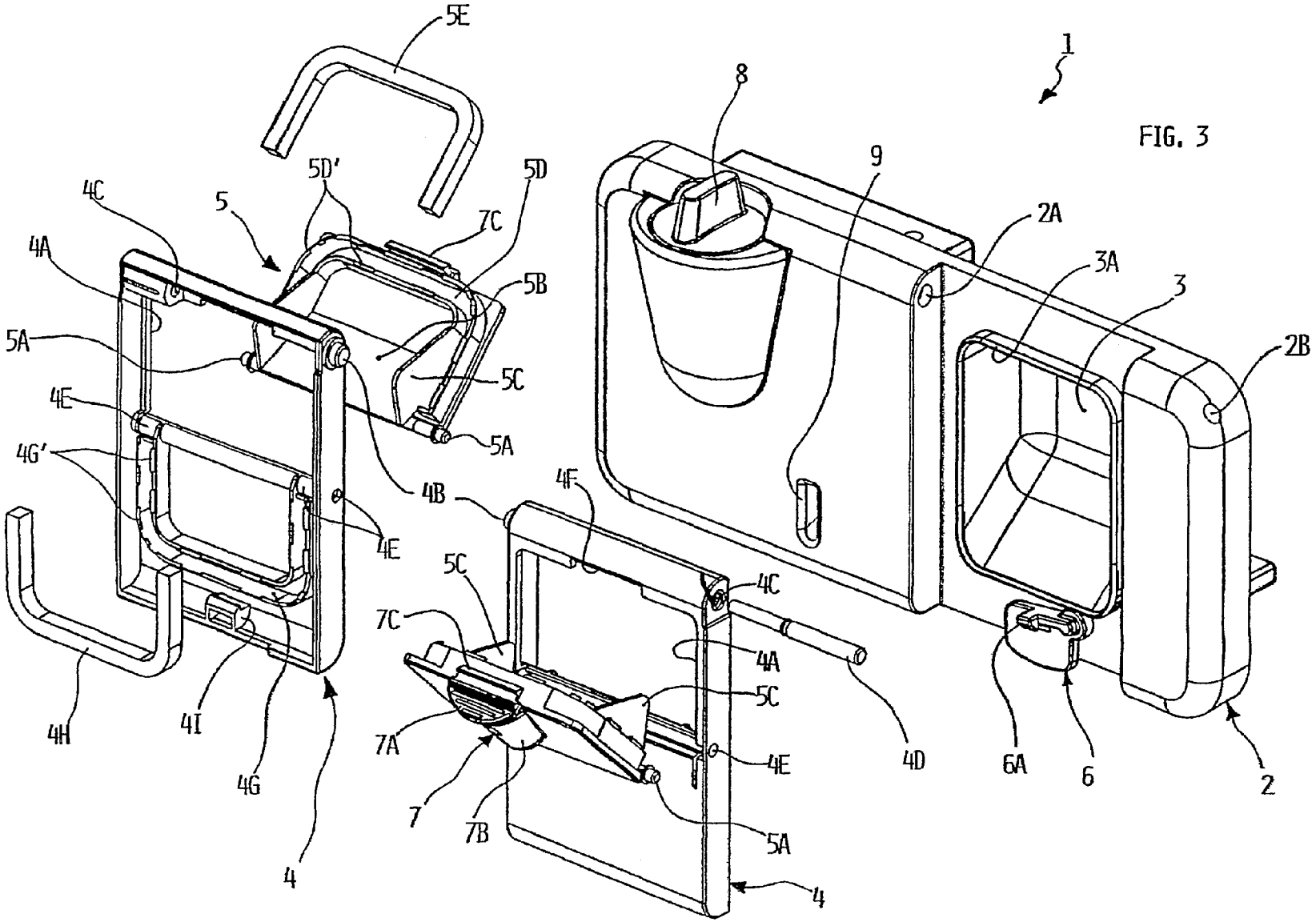
FIG. 3 shows an exploded view of some components of the washing agent dispenser according to the present invention, according to different views.

FIG. 3 shows an exploded view of the dispenser 1 according to the present invention, from which is possible to note the realisation of the cover 4 and flap 5; as it can be noticed, in the left area of FIG. 3 both the cover 4 and flap 5 can be seen from their side facing to recess 3 of the dispenser 1.

The cover 4, consisting e.g. of a single thermoplastic piece, shows the above mentioned loading window 4A substantially in its upper half.

On its upper end, the cover 4 has on one side an extension 4B apt to be inserted in a dead hole 2A of the body 2 of the dispenser, above the recess 3 containing the washing agent; on the opposite side with respect to the extension 4B, the cover 4 has a through-hole 4C for receiving the end of a pin 4D; this pin 4D is going to be inserted in a through-hole 2B in the body 2, opposite to the hole 2A.

As it can be noticed, the extension 4B, pin 4D and relevant holes 2A and 2B provide the hinging system of the cover 4 to the dispenser body 2; it should be noticed how a common spiral spring is also housed in the path 4C of the cover 4, for obtaining an automatic opening movement of the cover 4 when it is released from the lever 6, as further explained. On its lower end, the flap 5, also made of thermoplastic material, has on its lower end two side extensions 5A, apt to engage in apposite seats 4E delimited on the cover 4 substantially in line with or below the lower edge of the loading window 4A.

Therefore, the cover 4 has a seat or throat located on its side facing the machine wash tub, apt to receive the hinging means 5A of the flap 5; this throat, easily obtainable with the moulding of the element 4, prevents the use of additional pins and simplifies assembly of the flap 5 on the cover 4.

The extensions 5A and relevant seats 4E form the hinging system of the flap 5 to the cover 4; it should be noticed how also a common spiral spring can be housed in line with at least one of the seats 4E, so as to obtain an automatic opening movement of the flap 5 when released through the device 7.

Figure 5:
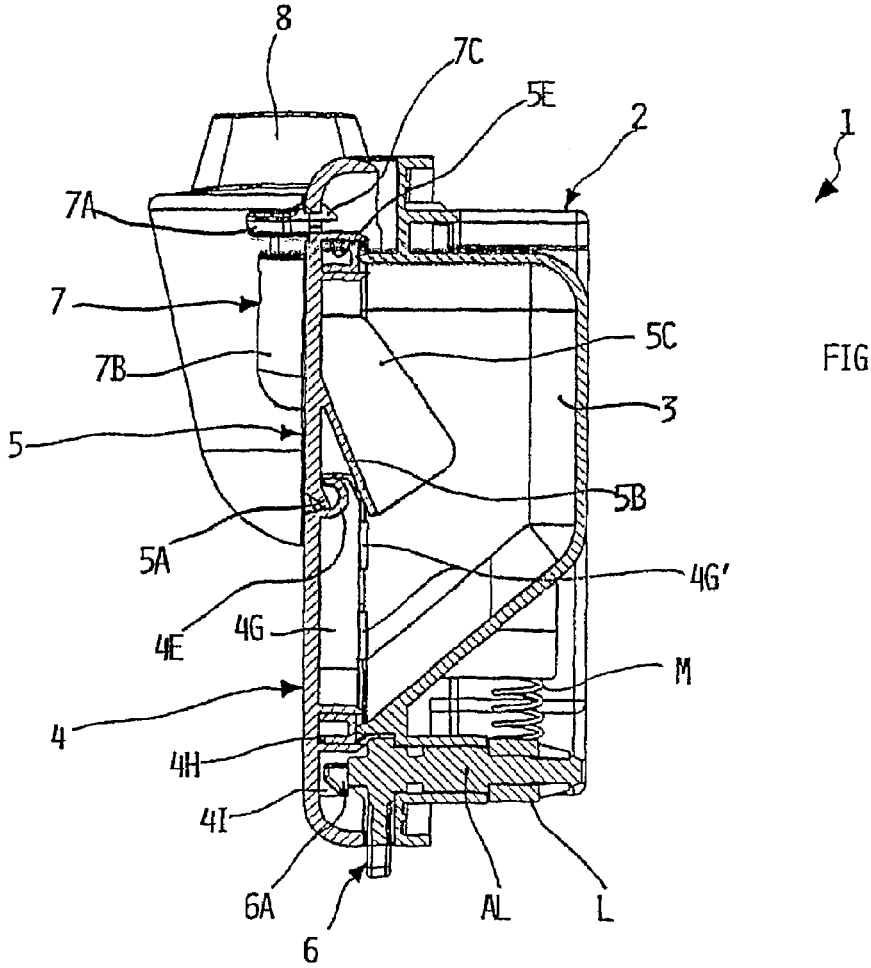
FIG. 5 shows a section along the axis A-A of FIG. 4 of the washing agent dispenser according to the present invention.

In this connection it is pointed out that the device 7 is preferably actuated manually; as shown in FIG. 5, it comprises substantially a push-button 7A, partially inserted in a housing 7B as a part of the flap 5, against the spring action of a spring, not visible in the figures; the push-button 7A is associated to an engaging tooth 7C, which is going to be coupled in a relevant seat 4F with suitable leads and hooks, delimited on the upper edge of the opening 4A of the cover 4.

From the rear surface of the flap 5 (i.e. facing the recess 3) an inclined surface 5B departs (see FIG. 4, too), extending towards the inside of the recess 3 over the laying axis of the extensions 5A and relevant seats 4E; on the sides of this inclined surface two substantially parallel walls indicated with 5C also depart and are apt to enter the recess 3; thus, the surface 5B and walls 5C form a sort of slipway and protection for the purposes further described.

On its side facing the recess 3, below the window 4A, the cover 4 has a substantially "U" shaped housing 4G formed by two parallel walls, which is going to contain a corresponding shape sealing gasket 4H; to this purpose, the upper edges of the inner and outer walls of the seat 4G have small teeth or projections 4G', whose function is to retain the gasket 4H in said seat.

Below the housing 4G there is a seat 4I, apt to co-operate with a hooking tooth 6A, delimited in the lever 6, in order to maintain the cover 4 in closing condition against the action of the spring present in the hole 4C.

Similarly, on its side facing the recess 3 the flap 5 has a housing 5D, substantially shaped like an upturned "U" and formed with two parallel walls, which is going to house a sealing gasket 5E of corresponding shape; also in this case, on the upper edges of the inner and outer walls of the seat 5D there are teeth or projections 5D', which are used to retain the gasket 5E in the above seat.

As it can be noticed, the above gaskets 4H and 5E form jointly the sealing means apt to avoid water and humidity penetration inside the recess 3 and/or an undesired outlet from it of a likely liquid washing agent used, during those wash cycles steps before dispensing the washing agent; in particular, these gaskets 4H and 5E will operate as a seal on a lip or wall 3A extending along the perimeter of the recess 3 containing the washing agent.

It should be noticed how the ends of the gaskets 4H and 5E may have a reduced thickness in line with the hinge 4E-5A, delimiting some thin extensions cooperating with each other (such as overlapping each other), so as to obtain a seal also in the hinge area itself.

Operation of the dispenser 1, according to a possible embodiment of the present invention, is now described with reference to one of its many applications, i.e. fastened to the surface of a tilting door facing inside the wash tub of a dishwashing machine.

Figure 4:
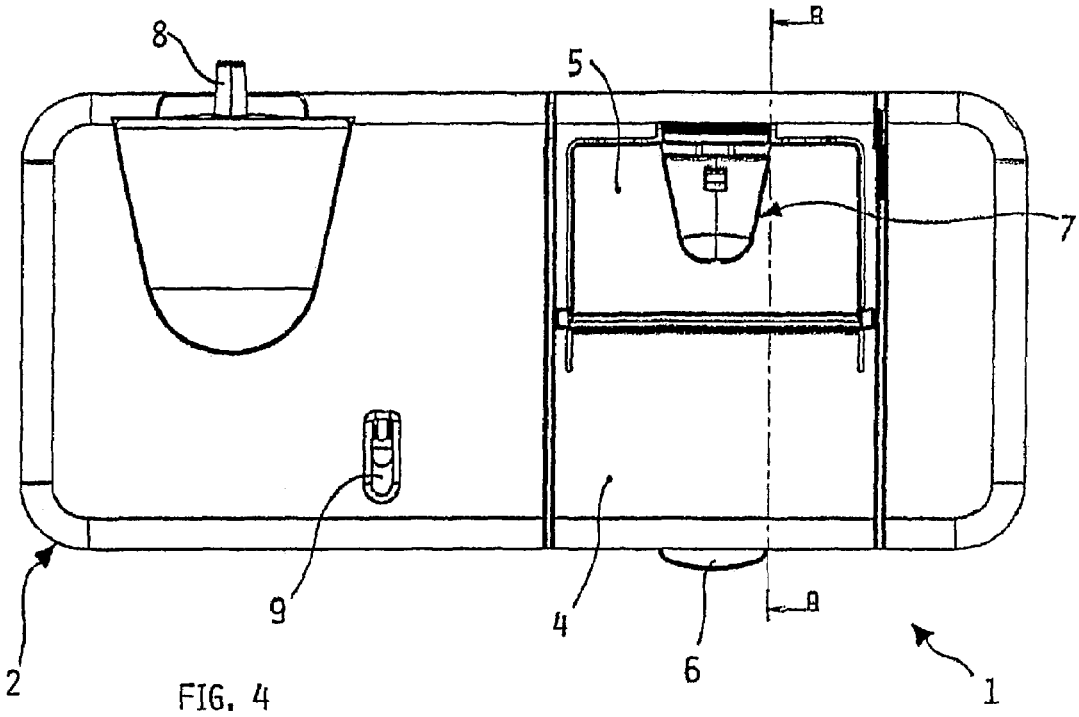
FIG. 4 shows a front view of the washing agent dispenser according to the present invention, in a first operating condition.

For simplicity's sake of the description, the dispenser 1 according to the present invention is assumed in the position shown in the FIGS. 1, 4 and 5.

In this condition, the lever 6 is engaged in its relevant seat 4I to keep the cover 4 of the recess 3 in the closed condition against the spring action in the hole 4C; similarly, the device 7 keeps the flap 5 of the loading window 4A in the closed condition, eventually contrasting the action of a relevant spring, if provided; the gaskets 4H and 5E seal the lip 3A of the recess 3.

Figure 6:
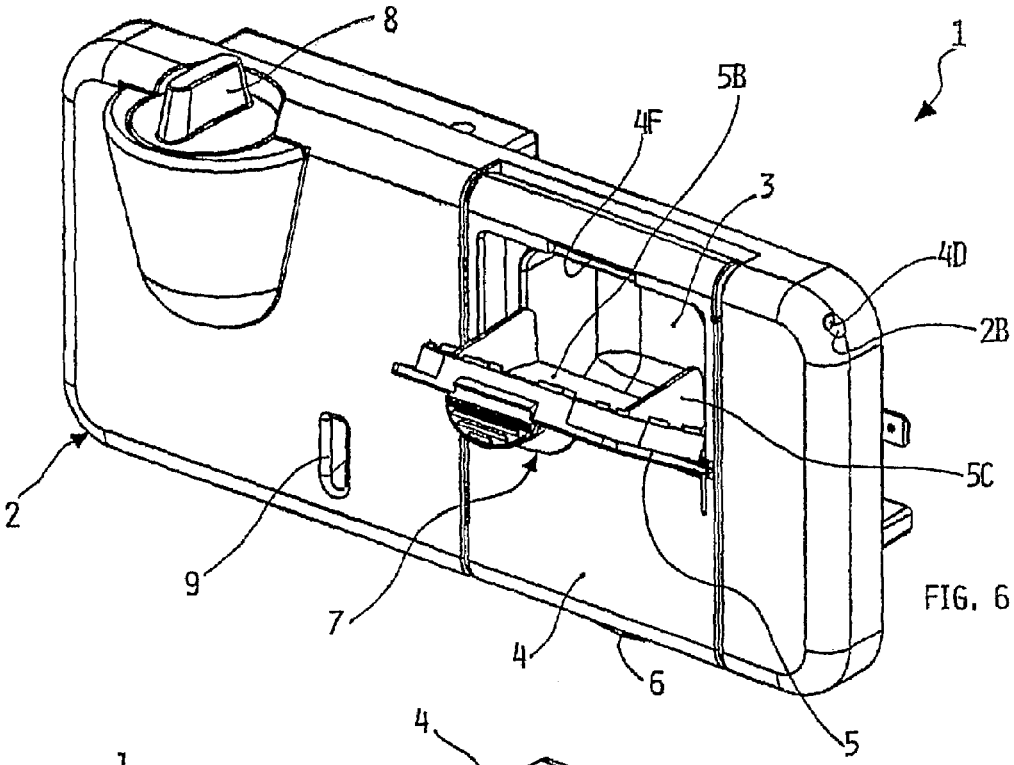
FIG. 6 shows a prospective view of the front side of the washing agent dispenser according to the present invention, in a second operating condition.
Figure 7:
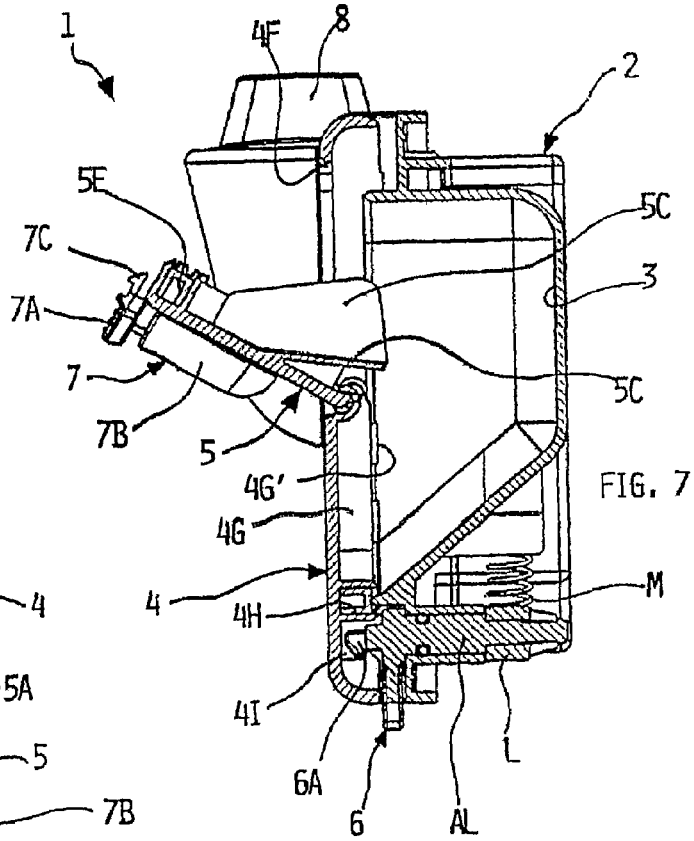
FIG. 7 shows a section along an axis alike axis A-A of FIG. 4 of the washing agent dispenser according to the present invention, in the operating condition of FIG. 6.

After loading the crockery to be washed in the machine wash-tub and with the dishwasher door half-open, the user opens the flap 5 pressing the push-button 7A of the device 7; the tooth 7C is released from its relevant seat 4F, so that the flap 5 can move angularly around the extensions 5A; the dispenser 1 will then take the operating condition represented in FIGS. 6 and 7.

It should be noticed how the coupling system between the flap 5 and cover 4 has common stop means (such as striker plates or projections), to stop the opening movement of the flap in the position represented in the FIGS. 6 and 7.

In this condition, the user is able to introduce the dose of washing agent required for performing the wash cycle in the recess 3, through the window 4A now open; this operation is improved by the slipway obtained with the inclined surface 5B and side walls 5C, which facilitates washing agent conveyance into the recess 3, reducing at the same time an accidental dispersion of it outside the dispenser 1 and/or on the hinging means of the cover 5. As illustrated in FIG. 7, since in this operating condition the surface 5B extends along with the walls 5C towards the inside of the recess 3, above and over the laying axis of the extensions 5A and relevant seats 4E, it will also avoid possible washing agents rests on the latter.

After the washing agent dose has been loaded, the user may therefore close the window 4A; to perform this, the flap 5 is pushed towards the cover 4 until the tooth 7C of the device 7 engages its relevant seat 4F again. Then the dispenser 1 will resume the condition of FIGS. 1 and 4.

Now the user can close the dishwasher door and start the wash cycle as usual. It should be noticed how during the initial wash-cycle phases, i.e. before dispensing the washing agent, the inside of the recess 3 is adequately isolated by the sealing action of the gaskets 4H and 5E on the lip 3A against any water sprays possibly hitting the dispenser 1.

At the appropriate time of the wash cycle, the machine control system will electrically supply the thermo-actuator 10 for a few instants; thereafter, the piston 10A moves downwards displacing the lever L angularly around the pin provided by the shaft AL; this movement of the lever L starts shaft rotation, which in its turn determines a movement of the lever 6 to release the cover 4; the latter, being subject to the spring action in the passage 4C will be free to move angularly around the extension 4B and pin 4D.

Figure 8:
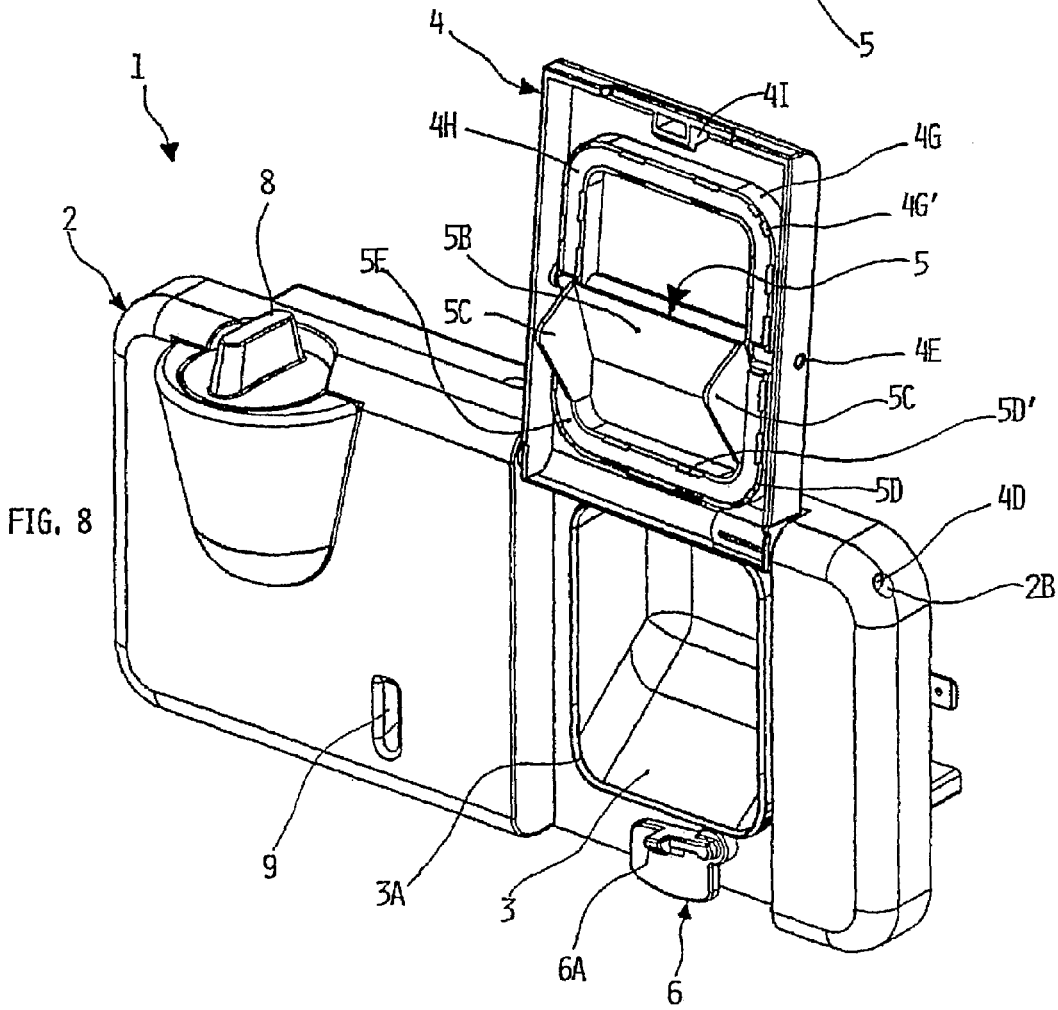
FIG. 8 shows a prospective view of the washing agent dispenser according to the present invention, in a third operating condition.
Figure 9:
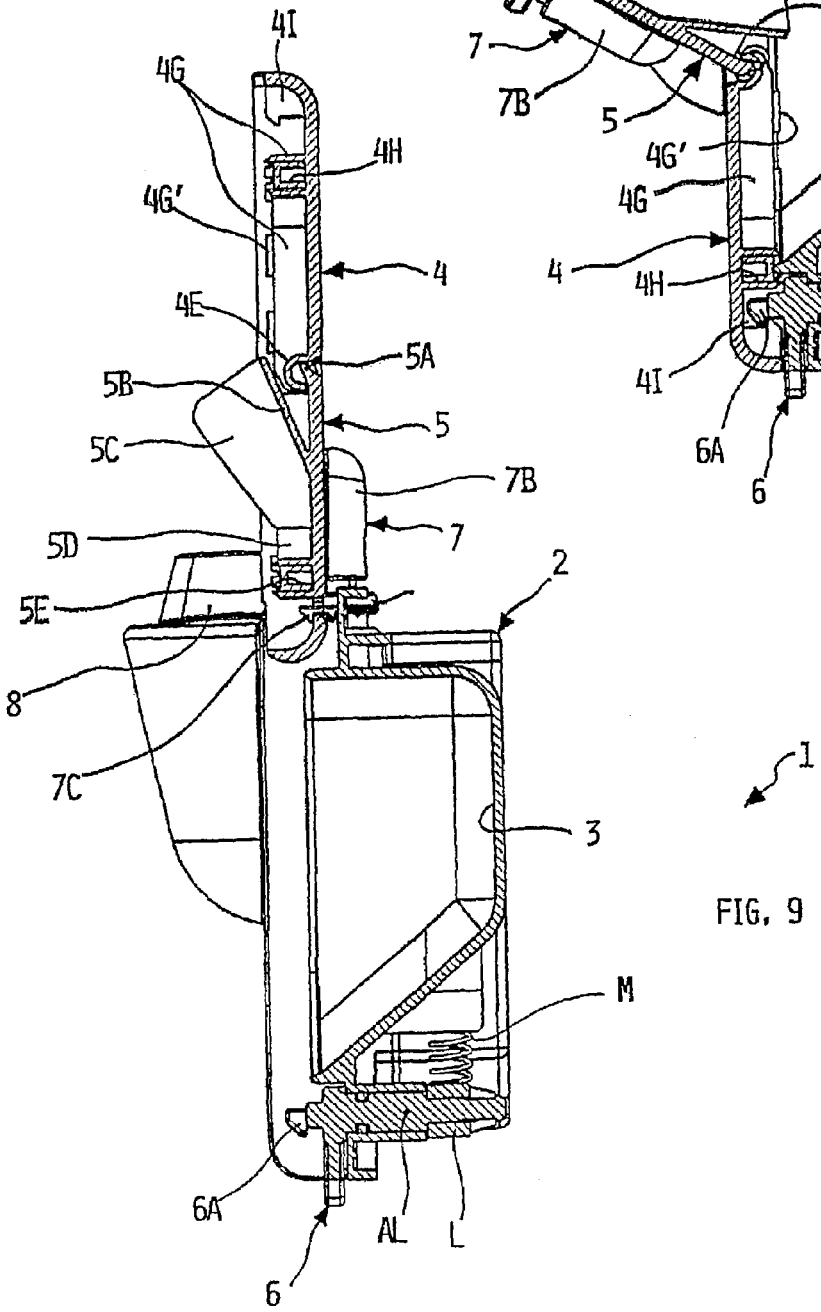
FIG. 9 shows a section along an axis alike axis A-A of FIG. 4 of the washing agent dispenser according to the present invention, in the operating condition of FIG. 8.

The dispenser 1 will then take the operating condition represented in the FIGS. 8 and 9, and the washing agent fall down by gravity from its own recess 3 into the wash tub of the dishwasher.

During this step, such washing agent discharge is favoured by the likely water sprays hitting the dispenser 1 and consequently the recess 3, which complete the removal of the washing agent; it should also be noticed how in the operating condition of FIGS. 8 and 9, the rear surfaces of both the cover 4 and flap 5 are directly facing inside the wash tub; as a result, the above water sprays actually wash the above rear surfaces, of the gaskets 4H and 5E, of the surface 5B and wings 5C, removing any washing agent rests left back on them. The wash cycle goes on according to common procedures; it should be noticed how before the end of this cycle, according to common procedures, the control system of the machine is also able to supply the actuator 11 for dispensing the required dose of liquid wash agent. Obviously, at the end of a wash cycle, i.e. before starting a new cycle and loading a relevant dose of washing agent, the user will have to close the cover 4 of the dispenser 1. This is performed imparting manually an angular movement to the cover 4 opposite the opening movement previously described, until the tooth 6A of the lever 6 engages again its relevant seat 4I (i.e. going from the condition shown in the FIGS. 8-9 to the one shown in the FIGS. 4-5).

The present invention has been described with reference to dispensing a detergent in powder, but it is clear that this invention is capable of application also for other types of washing agents, both in solid form (e.g. tablets) and liquid form, and/or gel, and/or foam; moreover, it is clear that the present invention can also be applied to washing machines differing from dishwashers, such as laundry washing machines.

In the above example, the dispenser 1 according to the present invention is assembled on a tilting door, but it is clear that in general, it could also be assembled on any consistent vertical surface delimiting the wash-tub of a machine; by way of example, the dispenser 1 can be advantageously applied on washing machines fitted with a linear sliding door on special guides or fitted with a single crockery basket structured like a sliding drawer, whose front wall actually forms the machine door; similarly, the dispenser according to the invention can also be utilized on dishwashing machines fitted with two loading doors, i.e. one being a tilting door and the other a sliding door.

However, should the dispenser according to the present invention be used on a machine fitted with a tilting door, the user will be able to load the washing agent in the recess 3 according to two different procedures.

In fact, besides the operating procedure previously described for loading the washing agent through the flap 5 with the machine door half-open, the user is also able to perform such loading in a conventional way, i.e. with the door fully open, using the functions associated to the cover 4 alone; in this event, it is quite obvious that being the cover 4 fully open, the recess 3 facing upwards will be directly accessible; after loading the washing agent, the user simply closes the cover 4 according to the above procedures.

From the above description and annexed claims that form an integral part of it, the features of the present invention will be clear. From the above description and annexed drawings also the advantages of the present invention are clear, in particular:

- the dispenser can be differently assembled either on tilting door and/or sliding doors and/or consistent vertical surfaces, and the loading of the washing agent can be performed in a comfortable easy position for the user;
- the invention, intended as dispenser fitted with a cover 4 and relevant flap 5, is also directly applicable to conventional dispenser structures, leaving unchanged both the manufacturing and operating features of the latter;
- the number of moving elements to realise the dispensing of the washing agent is very small, and also operating frictions are minimized;
- the manufacturing details related to the invention are just a few with a simple structure, which can be easily obtained by moulding;
- the actions required for loading the washing agent dose and its subsequent dispensing are quite elementary ones;
- the actuating means for operating the device have a simple operation and control, and are reliable in time.

It is obvious that many other changes are possible for the man skilled in the art to the washing agent dispenser for a household washing machine, namely a dishwasher, described above by way of example, without departing from the novelty spirit of the innovative idea. For instance, the present invention has been described with reference to the use of a thermo-actuator on the dispenser, but it is clear that this invention can also be implemented using other means, such as a motor with a likely reduction gear or electromagnetic actuator, or a pneumatic actuator, etc.

The dispenser 1 described by way of example may also be fitted with a kinematics apt to actuate at different times both the lever 6 and dosing/dispensing unit of the liquid washing agent contained in the relevant tank by means of one same actuating means, such as according to the technique described in EP-A-0 602 572, or FR-A-2.593.379, or DE-A-33 04 037.

FIGS. 10-12 describe a possible embodiment of the present invention with reference to the sealing means of the cover 4 and flap 5 with respect to the recess 3; it should be noticed that the reference numbers of the previous figures are used in these figures to indicated technical equivalent elements.

As it can be seen in FIG. 10, the suggested embodiment provides a sealing element substantially in the form of a membrane or foil, e.g. rubber or elastomer, indicated with 20 in its whole.

Such membrane 20 has a peripheral wall 20A apt to enter in the seats 4G and 5D located on the inner side of the cover 4 and flap 5, respectively; however, as it can be seen, according to this embodiment the teeth or projections 4G' and 5D' are only provided on the upper edges of the outer wall of the seats 4G and 5D.

Moreover, FIG. 10 shows the wall 20A having interruptions 20B in the middle part of the membrane 20, i.e. substantially in line with the hinging seat locations 4E of the flap 5.

In its upper half the membrane 20 also has one or more passages 20C for receiving corresponding extensions AP departing from the inner side of the flap 5.

Always in FIG. 10, reference 21 indicates a component forming the above conveying and protecting slipway, which integrates the walls previously indicated with 5C and the inclined surface 5B; as it can be seen, the component 21 has a flat length 21A extending between the walls 5C, wherefrom the inclined surface 5B is also departing; over this length 21A a number of through-holes 21B equalling the number of the extensions AP and passages 20C are delimited.

As it can be seen e.g. from FIG. 11, the component 21 is so assembled to let the projecting portion of the extensions AP from the passages 20C also go through the holes 21B; the ends of the extensions AP protruding from the holes 21B are mechanically or heat deformed to ensure a precise safe coupling between the flap 5 and component 21, with interlaying the membrane 20.

As it can be seen, dispenser operation according to the above embodiment is exactly like the one previously described with reference to the FIGS. 1-9.

With both the cover 4 and flap 5 closed, the membrane 20 is in the condition shown in FIG. 11, i.e. arranged substantially flat; in this condition, the membrane surface 20 opposite the one determining the wall 20A is pressed on the lip 3A of the recess 3, ensuring sealed operation.

When opening the flap 5 according to the above procedures, the membrane 20 will be free to deform elastically, i.e. to bend outside the recess 3, substantially in line with the area delimiting the seats 4E on the cover 4, as shown in FIG. 12.

In the embodiments described above by way of example, the dispenser according to the present invention is fitted with a cover 4 of the tilting type, i.e. angular movable by means of suitable hinging means.

However, according to another possible embodiment of the present invention, it is clear that the door to which the flap 5 should be hinged either be a sliding or linear movable door type, in particular according to a mainly parallel direction with respect to the surface on which the dispenser is fastened, such as described in EP-A-780 087, whose teachings are incorporated herein for reference.

According to another possible embodiment, the cover previously indicated with 5, instead of being a flap or provided anyway for its opening through an angular movement on a substantially horizontal axis, may move linearly to the tub inner side or to the outer side of the dispenser body, and substantially have a sliding drawer configuration; also, the cover 5 may be structured like a common drawer moving angularly on a vertical axis and have a plan view substantially a sector circular shape.

The device 7 may be integral with the cover 4 instead of the flap 5; also, the dispenser according to the invention may have several covers 4 fitted with their relevant flap 5, if required.

At the limit, both the flap 5 and window 4A may be located in the intermediate area of the cover 4 instead of being located in the upper or lower side of the cover 4.

According to another possible embodiment, the dispenser according to the invention may be so conceived to provide the main cover 4 for loading the washing agent in the recess 3, while the flap 5 is used to discharge the washing agent towards the machine wash tub.

According to this embodiment:

- the cover 4 will be preferably hinged in its lower section to the body 2 of the dispenser (instead of its upper section, as in FIGS. 1-12), so as to provide an aperture to facilitate loading the washing agent for the user;
- the flap 5 will be preferably hinged in its upper section to the cover 4 (instead of its lower section, as in FIGS. 1-12),
- the flap 5 and the window 4A will be arranged in the lower section of the cover 4.

Always according to this embodiment, the cover 4 will have a manual opening/closing device, of the type previously indicated with 7, whereas for the flap 5 will be provided an opening/closing system actuated by the control system of the machine (i.e. like the one previously described consisting of thermo-actuator 10, lever L, spring M, shaft AL and lever 6).

Referring specifically to the above embodiment, several flaps 5 assembled on at least one cover 4 may also be provided, in particular in the event of a recess 3 divided in two or more separate compartments (i.e. one for powder or liquid washing agent, the other for a washing agent in the form of a tablet). According to this embodiment, the dispenser will have an arrangement actuated by the control system of the machine for the selective opening of the flaps at subsequent time intervals; thus, the control system may selectively actuate the opening of the flaps for dispensing the various washing agents at the right times of the wash cycle (i.e. dispensing the powder agent during a first wash step and the washing agent in the form of a tablet during a second wash step).

Figure 13:
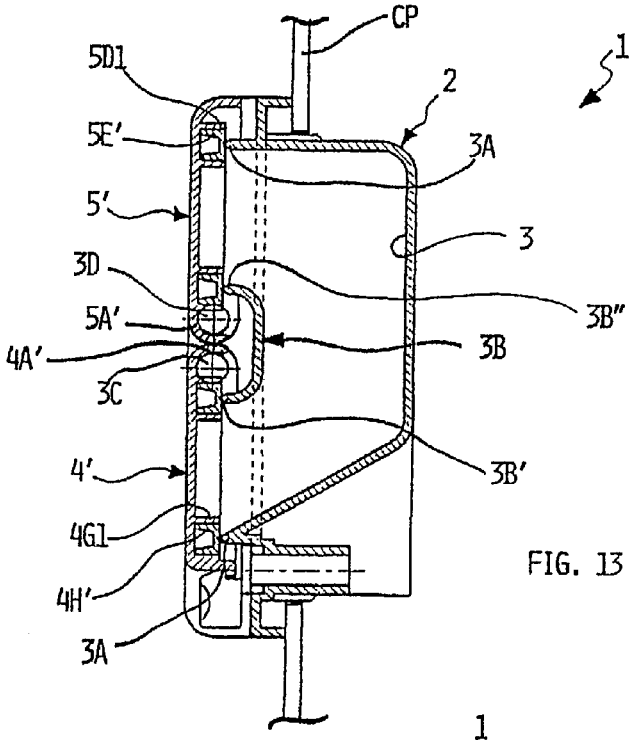
FIGS. 13, 14 and 15 show respective schematic sectional views of a washing agent dispenser according to a second possible embodiment of the present invention, in three different operating conditions.
Figure 14:
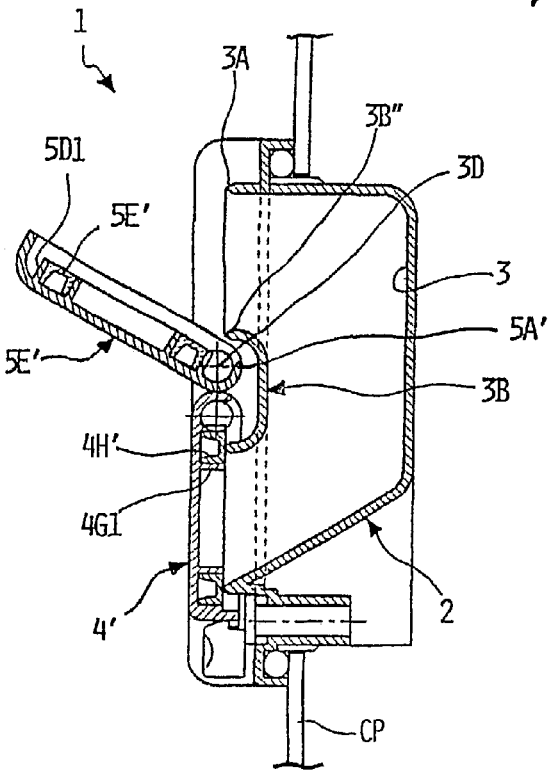
Figure 15:
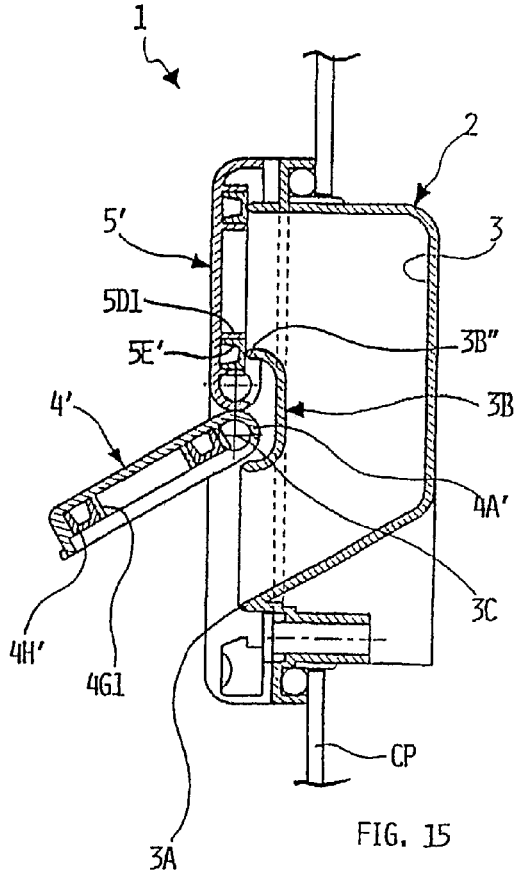

FIGS. 13, 14 and 15 shows schematically another possible embodiment of the present invention, wherein two separate doors are associated to one same recess containing the washing agent; it should be noticed that FIGS. 13-15 partially use the same reference numbers of the previous figures to indicate technical equivalent elements, and some of the elements previously described are not visible or have been omitted for simplicity's sake. In these figures, the dispenser 1 is assembled in a special aperture on a vertical wall CP, which delimits a wash tub of the machine.

As it can be noticed in this embodiment, in line with the front section of the recess 3 containing the washing agent, the body 2 of the dispenser I delimits an intermediate crossbar indicated with 3B in the figures, which comprises of the hinging pins 3C and 3D. Reference 4' indicates a lower cover with engaging seats 4A' on its upper section apt for coupling—e.g. snap coupling—to the lower pin 3C of the crossbar 3B. Vice-versa, reference 5' indicates an upper cover with engaging seats 5A' in its lower section apt for coupling—e.g. snap coupling—to the upper pin 3D of the crossbar 3B.

As it can be seen, the cover 4' is hinged in its upper section to the dispenser body 2, whereas the cover 5' is hinged in its lower section to the body 2, both covers 4' and 5' being tilting on a substantially horizontal axis, like the covers 4 and 5 of FIGS. 1-12.

It should also be noticed how also in the embodiments of FIGS. 13-15 a suitable common spring may be provided for automatic opening movement of the cover 4' and/or cover 5', when the latter is released.

The cover 5' has a suitable opening/closing device, not shown, similar to the one previously indicated with 7; similarly, the cover 4' has an opening/closing system, also not shown, actuated by the control system of the machine (such as previously described, i.e. consisting of the actuator 10, lever L, spring M, shaft AL and lever 6).

On its side facing the recess 3, the cover 4' has a housing 4G1, substantially of square shape with rounded corners, which is going to contain sealing gasket 4H' with a corresponding shape; similarly, on its side facing to recess 3, the cover 5' has a housing 5D1, like housing 4G1, which is going to contain a sealing gasket 5E'.

As it can be seen in FIG. 13, where both covers 4' and 5' are shown in closed condition, the gasket 4H' is suitable to seal both the lip 3A extending along the perimeter of the recess 3 and a lower front lip 3B' of the crossbar 3B; similarly, the gasket 5E' is suitable to seal both the lip 3A and upper front lip 3B" of the crossbar 3B.

As it can be seen, both gaskets 4H' and 5E' form jointly the sealing means to prevent water and humidity penetration inside the recess 3 and/or an undesired discharge of a likely liquid washing agent employed during those wash cycle steps that precede dispensing of the washing agent itself.

It should be considered that the rear surface of the upper cover 5' may advantageously have an inclined surface, like the one already indicated with 5B, and of the walls substantially parallel like to one already indicated with 5C, apt to obtain a slipway and protection for the same purposes previously described.

Finally, also the embodiment presently described, the coupling system between the covers 4' and 5' and the crossbar 3B will have fitted with suitable end limiting means to stop the opening movement of the cover 5' in the position shown in FIG. 14, and of the cover 4' in the position shown in FIG. 15.

Operation of the dispenser according to the embodiment of the FIGS. 13-15 is very simple.

For simplicity's sake of description, also in this instance the dispenser is assumed in the position shown in the FIG. 13; in this condition, the cover 4' is retained in its closed condition by the relevant opening/closing system; similarly, the cover 5' is maintained closed by the relevant opening/closing device.

After loading the crockery to be washed in the wash tub of the machine and with the dishwasher door half-open, the user opens the cover 5' actuating the relevant opening/closing device; the dispenser 1 will then take the operating condition shown in FIG. 14.

In this condition, the user can introduce in the recess 3 the dose of washing agent required for executing a wash cycle; this operation is favoured by said slipway, which improves introduction of the washing agent in the recess 3, reducing at the same time an accidental dispersion of it outside the dispenser 1 and/or on the cover hinging means.

Once the dose of washing agent has been loaded, the user can close the cover 5' again. The dispenser 1 will then go back to the condition represented in FIG. 13.

Now, the user may close the dishwasher door and start the wash cycle as usual. It should be noticed that during the starting steps of the wash cycle, i.e. before dispensing the washing agent, the inside of the recess 3 is adequately isolated from the water sprays eventually hitting the dispenser 1, by virtue of the sealing action performed by the gaskets 4H' and 5E' on the lip 3A of the recess 3 and on the lips 3B' and 3B" of the crossbar 3B.

At the appropriate time of the wash cycle, the control system of the machine actuates the opening/closing system of the cover 4', as previously described, so that the latter is released and is able to open under the relevant spring action.

Then the dispenser 1 takes the operating condition represented in FIG. 15 and the washing agent can fall down by gravity from its recess 3 into the wash tub of the dishwasher.

The wash cycle goes on according to common procedures; obviously, at the end of a wash cycle, but before starting a new cycle and loading the relevant dose of washing agent, the user has to close the cover 4' of the dispenser 1 again; this is performed through a manual angular movement of the cover 4' opposite the opening movement previously described, until the relevant engagement is reached.

As it can be seen, also the embodiment represented in FIGS. 13-15 ensures the achievement of the objects of the invention and to obtain the relevant advantages in terms of assembly flexibility (on tilting doors, sliding doors, consistent vertical surfaces), loading of the washing agent in a comfortable easy position for the user, a reduced number of components and moving parts for operation, simple manufacture and easy utilization.

Obviously, also the cover 4' may be a linear sliding cover instead of a tilting cover.

According to another possible embodiment, the covers 4-4' and 5-5' may be replaced by one single cover, capable of taking at least two different operating conditions for a partial opening of the recess 3, i.e. one for loading the washing agent and the other for its subsequent dispensing.

For instance, this single cover may be a tilting cover type hinged on its lower end, which can be moved angularly by the user to reach a first intermediate position for a partial opening of the recess 3 to load the washing agent; this intermediate opening position may be determined e.g. by an appropriate mechanical stop of the angular opening of the cover. It should be noticed how the cover may have an inclined surface on its rear side and its side walls like the ones previously indicated with 5B and 5C, respectively, so as to improve washing agent conveyance into the relevant recess containing it.

After loading the washing agent and closing the cover again, said stop means will be displaced, e.g. by means of a suitable actuator during the wash cycle, in order to remove any hindrance for a subsequent angular movement of the cover. Thus, at an appropriate time during the cycle, when the cover is released by an opening/closing system as previously described, it is free to tilt completely over due to a suitable spring action, until a nearly full opening of the washing agent compartment is reached, with a consequent dispensing of the washing agent into the wash tub of the machine.

Advantageously, the actuator for displacing the above stop may be part of the same opening/closing system of the cover.

It is obvious that many other changes are possible for the man skilled in the art to the washing agent dispenser for a household washing machine, namely a dishwasher, as described above, and it is also clear that in practical actuation of the invention the components may often differ in form, size, proportions and materials employed from the ones described above by way of example, and be replaced with technical equivalent elements.

The invention claimed is:

1. A washing agent dispenser device for a household washing machine, namely a dishwasher, said dispenser being mounted inside the wash tub of said washing machine, said dispenser having a body delimiting at least a recess for containing washing agent for a wash cycle realization, and comprising occlusion means for said recess, where loading said washing agent in said recess is performed manually and dispensing of the washing agent occurs at least partially by gravity, said occlusion means comprising:

at least a first cover, that is capable of taking at least a closed position and another position in a first operating condition for at least a partial opening of said recess, the latter to enable loading of said washing agent into said recess, at least a second cover, that is capable of taking at least a closed position and further position in an operating condition to ensure discharging of said amount of washing agent from the recess outwardly, and an intermediate crossbar comprising two hinging means that hingedly attach the first and second covers to the crossbar, wherein said first cover is hingedly attached to the crossbar in its lower section so that in its first operating condition an upper portion of the recess is at least partially opened and said second cover is hingedly attached to the crossbar at its upper section so that in its operating condition a lower portion of the recess is at least partially opened.

2. A device, according to claim 1, wherein said first cover is capable of taking respective opening and closing positions, independently from the opening and closing position being taken by said second cover.

3. A device, according to claim 1, wherein said second cover is of a tilting type, in particular over a substantially horizontal axis.

4. A device, according to claim 1, further comprising sealing means for isolating the inside of said recess.

5. A device, according to claim 4, wherein said sealing means are partially coupled to said first cover and to said second cover.

6. A device, according to claim 1, wherein said first cover has housing means for at least a portion of a sealing gasket.

7. A device, according to claim 1, wherein said second cover has housing means for at least a portion of a sealing gasket.

8. A device, according to claim 4, wherein said sealing means comprise a gasket only fastened to said first cover.

9. A device, according to claim 4, wherein said sealing means comprise a gasket only fastened to said second cover.

10. A device, according to claim 4, wherein said sealing means comprise a single gasket, fastened to both said first cover and said second cover.

11. A device, according to claim 1, further comprising means to convey said amount of washing agent towards the inside of said recess, when said first cover is in its respective operating condition.

12. A device, according to claim 11, wherein said conveying means comprise at least an inclined surface in the section of said first cover facing said recess.

13. A device, according to claim 12, wherein said conveying means comprise at least two walls, in particular substantially parallel, in the section of said first cover facing said recess.

14. A device, according to claim 13, wherein said inclined surface and/or said walls are an integral part of said first cover.

15. A device, according to claim 13, wherein said inclined surface is part of a component associated with said first cover.

16. A device, according to claim 2, further comprising first engaging means to maintain said first cover in its respective closed position.

17. A device, according to claim 16, wherein said first engaging means are provided between said second cover and said first cover.

18. A device, according to claim 16, wherein said first engaging means are capable of actuation to let said first cover go from its respective closed position to its respective open position.

19. A device, according to claim 16, wherein said first engaging means are actuated manually.

20. A device, according to claim 16, wherein said first engaging means are associated to said second cover.

21. A device, according to claim 16, wherein said first engaging means are associated to said first cover.

22. A device, according to claim 6, wherein said gasket is substantially "U" shaped.

23. A device, according to claim 10, wherein said single gasket has substantially the form of a membrane.

24. A device, according to claim 6, wherein said housing means comprise at least a seat, which is at least partially delimited by two parallel walls.

25. A device, according to claim 24, further comprising retaining means for said gasket on the upper edge of at least one of said walls.

26. A device, according to claim 1, wherein said first cover is biased by an elastic element or spring.

27. A device, according to claim 1, wherein said second cover is biased by an elastic element or spring.

28. A device, according to claim 1, wherein said recess is adapted to contain at least a washing agent tablet.

29. A device, according to claim 1, further comprising second engaging means for maintaining said second cover in its respective closed position.

30. A device, according to claim 29, further comprising actuating means of said second engaging means, which are controlled by the control system of the washing machine on which the device is assembled.

31. A device, according to claim 30, wherein said actuating means comprise an actuator, namely a thermal or thermoelectric actuator type.

32. A device, according to claim 1, further comprising means for dispensing at least a dose of a second washing agent in liquid form.

33. A device, according to claim 31, wherein said actuator is also provided to produce the actuation of said arrangement.

34. A device, according to claim 1, further comprising a plurality of said first covers and/or said second covers.

35. A device, according to claim 34, wherein said recess is divided at least in two separate compartments.

36. A device, according to claim 34, further comprising means for selective opening of said second covers at different times, actuated by the control system of the machine.

37. A device, according to claim 2, further comprising end stroke means for stopping the opening movement of said first cover and/or of said second cover.

38. A device, according to claim 1, wherein said lower section of said first cover is proximate said upper section of said second cover.

39. A device, according to claim 1, wherein said hinging means comprise hinging pins adapted to be coupled with respective engaging seats in a way to operatively couple said first cover and said second cover to said intermediate crossbar.

40. A device, according to claim 1, further comprising separating means to separate said hinging means from the contact with the washing agent positioned into said recess of said body, in particular when said covers are in closed position.

41. A device, according to claim 40, wherein said separating means are in contact with sealing means of said first cover and second cover when said covers are in closed position.

42. A device, according to claim 40, wherein said separating means comprise a crossbar having lips adapted to interact with said sealing means of said covers to perform a sealing action.

43. A device, according to claim 1, farther comprising engaging means for securing said first cover and said second cover, fixed to said body between said first cover and said body and between said second cover and said body.

44. A device, according to claim 43, wherein said engaging means are fixed next to opposite ends of said body.

45. A dishwasher comprising:

a wash tub;

a door that allows access to the interior of the wash tub and can be closed during a wash mode;

a body affixed to the inside of the door and delimiting a recess for containing a washing agent;

a compound cover covering the recess, the compound cover comprising a first cover and a second cover each capable of taking open and closed positions;

an intermediate crossbar comprising two hinging means that hingedly attach the first and second covers to the crossbar, wherein said first cover is hingedly attached to the crossbar in its lower section so that in its first operating condition an upper portion of the recess is at least partially opened and said second cover is hingedly attached to the crossbar at its upper section so that in its operating condition a lower portion of the recess is at least partially opened, the first cover being capable of opening to allow loading of washing agent into the recess, and;

the second cover being capable of opening to allow washing agent to drain from the recess at least partially due to gravity.

46. The washing agent dispenser device of claim 45, wherein the first cover is capable of taking respective opening and closing positions independently from the opening and closing position being taken by the second cover.

* * * * *